US007180722B2

(12) United States Patent
Jacobs et al.

(10) Patent No.: US 7,180,722 B2
(45) Date of Patent: Feb. 20, 2007

(54) ALTERNATING CURRENT MONITOR FOR AN IONIZER POWER SUPPLY

(75) Inventors: Michael A. Jacobs, Lansdale, PA (US); John A. Gorczyca, Lansdale, PA (US); Ken S. Foo, Lansdale, PA (US)

(73) Assignee: Illinois Tool Works, Inc., Glenview, IL (US)

( * ) Notice: Subject to any disclaimer, the term of this patent is extended or adjusted under 35 U.S.C. 154(b) by 240 days.

(21) Appl. No.: 10/875,982

(22) Filed: Jun. 24, 2004

(65) Prior Publication Data

US 2005/0286201 A1 Dec. 29, 2005

(51) Int. Cl.
*H01T 23/00* (2006.01)
*H05F 3/00* (2006.01)

(52) U.S. Cl. ..... 361/231; 361/230

(58) Field of Classification Search ..... 361/230, 361/231

See application file for complete search history.

(56) References Cited

U.S. PATENT DOCUMENTS 3,714,531 A 1/1973 Takahashi ..... 317/262 A
3,936,698 A 2/1976 Meyer ..... 317/4
4,878,149 A * 10/1989 Stiehl et al. ..... 361/230
5,930,105 A * 7/1999 Pitel et al. ..... 361/212
6,130,815 A * 10/2000 Pitel et al. ..... 361/212
6,259,591 B1 7/2001 Pitel et al. ..... 361/212
6,504,700 B1 1/2003 Hahne et al. ..... 361/212
2002/0069759 A1* 6/2002 Allen ..... 96/55

* cited by examiner

*Primary Examiner*—Stephen W. Jackson
*Assistant Examiner*—Dharti H. Patel
(74) *Attorney, Agent, or Firm*—Mark W. Croll; Paul F. Donovan

(57) ABSTRACT

An ionizer includes an alternating current (AC) voltage source having an output outputting a waveform with a positive half-cycle and a negative half-cycle, an electrode electrically coupled to the output of the AC voltage source, a reference proximate the electrode and a sensing circuit. The sensing circuit includes a return current nulling node electrically coupled to the output of the AC voltage source and the reference, a ground node separately electrically coupled to ground, a positive ion current sensor and a negative ion current sensor. The positive ion current sense node is configured to output a positive ion signal proportionate to a sensed positive ion current. The negative ion current sense node is configured to output a negative ion signal proportionate to a sensed negative ion current.

18 Claims, 9 Drawing Sheets

120
150
FROM FIG. 4A
+Vcc
R46
RLY3
LED5
RN1
A
B
C
D
R35
C10
R36
U4D
D10
R48
RLY4
LED6
R33
U4C
R34
C6
D11
Q2
R44
D12
U4B
C5
R50
RLY5
LED7
R37
U4A
R38
R39
C4
D14
R45
Q3
146
R27
R28
R29
R26
U3A
U3B
R23
R24
R25
C9
LED8
W2
C12
U5
R30
R31
R32
149
148
C11

TYPICAL METHOD TO MEASURE CURRENT IN AN AC IONIZER

RESULTS OF AC WAVEFORM SHAPING

ALTERNATING CURRENT MONITOR FOR AN IONIZER POWER SUPPLY

BACKGROUND OF THE INVENTION

The present invention is directed to air ion generators and, more specifically, to an apparatus for sensing and monitoring alternating current in a power supply of an air ionizer.

Controlling static charge is an important issue in continuous web operations (product moved in a continuous or nearly continuous feed) and in semiconductor manufacturing. Undesirable Triboelectric (static caused by friction) charges are introduced onto the web during handling by rollers, cutters and the like. In web operations, such undesirable charges can attract unwanted particulate matter onto the product, can cause difficult handling issues with the product, and may even cause discharges which are potentially harmful to the electronic controls that operate the machines. In semiconductor manufacturing, device defects caused by electrostatically attracted foreign matter and electrostatic discharge events contribute greatly to overall manufacturing losses.

Air ionization is an effective method of eliminating static charges on non-conductive materials and isolated conductors. Air ionizers generate large quantities of positive and negative ions in the surrounding atmosphere which serve as mobile carriers of charge in the air. As ions flow through the air, they are attracted to oppositely charged particles and surfaces. Neutralization of electrostatically charged surfaces can be rapidly achieved through this process.

Air ionization may be performed using electrical ionizers which generate ions in a process known as corona discharge. Electrical ionizers have electrodes and generate air ions through this process by intensifying an electric field around a sharp point of each electrode until it overcomes the dielectric strength of the surrounding air. Negative corona occurs when electrons are flowing from the electrode into the surrounding air. Positive corona occurs as a result of the flow of electrons from the air molecules into the electrode.

Ionizer devices take many forms such as ionizing bars, air ionization blowers, air ionization nozzles, and the like, and are utilized to neutralize static electrical charge by emitting positive and negative ions into the workspace or onto the surface of an area carrying undesirable static charges. Ionizing bars are typically used in continuous web operations such as paper printing, polymeric sheet material, or plastic bag fabrication. Air ionization blowers and nozzles are typically used in workspaces for assembling electronics equipment such as hard disk drives, integrated circuits, and the like, that are sensitive to electrostatic discharge (ESD).

To achieve the maximum possible reduction in static charges from an ionizer of a given output, the ionizer must produce amounts of positive and negative ions in order to compensate for the net charge on the web or in the workspace. That is, the output of the ionizer must increase or decrease the output of positive and/or negative ions in order to achieve a neutralized net charge on the web or in the workspace.

One prior art method of generating ions is by use of an alternating current (AC) voltage generator connected to ionizing pins (i.e., electrodes) which produces ions of one polarity for approximately 35% of a half-cycle and then, after a delay, produces ions of the other polarity for approximately 35% of a half-cycle. The positive ions and negative ions are output based upon the cycle or frequency of the AC voltage waveform and are not controlled based upon feedback of the actual charge on the web or in the workspace or on the demand for ions of a particular polarity. Such prior art devices are discussed in U.S. Pat. No. 3,936,698 (Meyer) and U.S. Pat. No. 3,714,531 (Takahashi).

A drawback to AC ionizers is the ability to monitor the actual current flow being delivered to the ionizing pins. Shields and ground references serve as an additional load on the AC high voltage, thereby drawing current that is orders of magnitude larger than the actual ion current produced by the ionizing pins. For example, FIG. 5 is a simplified electrical schematic of a prior art monitor circuit 50 that measures return current to a secondary 54 of a high voltage transformer 52 through a grounded resistor $R_G$. When a shielded high voltage cable 51 is used to distribute AC high voltage to ionizing pins of an ionizer bar, the resulting signal across the ground resistor $R_G$ will predominantly represent a load current of the cable 51. Ion current is only a small fraction of a total current returning to the transformer and is difficult to detect relative to the large current supplied to the shield and ground references. The typical method to measure the current in the ionization system would include measuring the voltage across the ground resistor $R_G$. Using Ohms law, I=E/R, the current can only be calculated as the total current returning to the high voltage transformer 52.

It is desirable to provide a way of accurately measuring alternating current in an ionization system. Moreover, it is desirable to provide an apparatus and method for measuring alternating current flow due to ion generation out of electrodes of an ionization system.

BRIEF SUMMARY OF THE INVENTION

Briefly stated, the present invention provides an ionizer that includes an alternating current (AC) voltage source having an output outputting a waveform with a positive half-cycle and a negative half-cycle, an electrode electrically coupled to the output of the AC voltage source, a reference proximate the electrode and a sensing circuit. The sensing circuit includes a return current nulling node electrically coupled to the output of the AC voltage source and the reference, a ground node separately electrically coupled to ground, a positive ion current sensor and a negative ion current sensor. The positive ion current sensor has a positive ion current sense node and is coupled between the return current nulling node and the ground node. The positive ion current sense node is configured to output a positive ion signal proportionate to a sensed positive ion current. The negative ion current sensor has a negative ion current sense node and is coupled between the return current nulling node and the ground node. The negative ion current sense node is configured to output a negative ion signal proportionate to a sensed negative ion current.

The present invention also comprises an ionizer that includes an alternating current (AC) voltage source having an output outputting a waveform with a positive half-cycle and a negative half-cycle, an electrode electrically coupled to the output of the AC voltage source, a reference proximate the electrode, a shielded cable having a conductor and a shield and a sensing circuit. The conductor connects the output to the electrode. The sensing circuit includes a return current nulling node electrically coupled to the output of the AC voltage source and the reference, a ground node separately electrically coupled to ground and an ion current sensor having an ion current sense node and being coupled between the return current nulling node and the ground node. The shield of the shielded cable connects the reference to the return current nulling node. The ion current sense node is configured to output an ion signal proportionate to a sensed ion current.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1A:
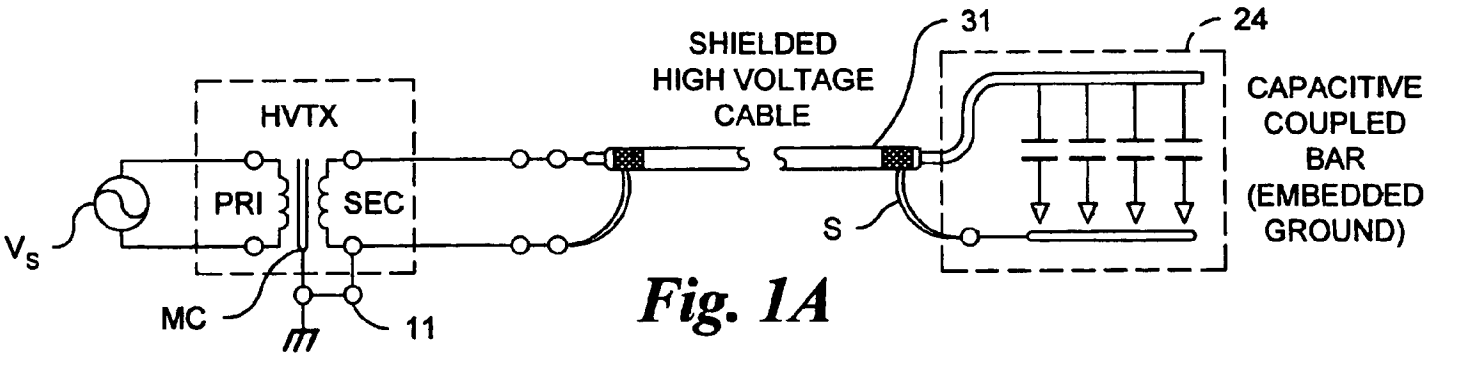
FIG. 1A is a simplified electrical schematic of a capacitive coupled ionizer bar which can incorporate the preferred embodiments of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of any device described and designated parts thereof. The terminology includes the words above specifically mentioned, derivatives thereof and words of similar import. Additionally, the word "a" is used in the claims and in the corresponding portions of the specification, means "one" or "at least one." The term "target," as used herein, may be an object being worked on, a continuous web product like paper, plastic, or the like, or the target may simply be a general workspace or area.

Referring now to the drawings in detail, wherein like numerals indicate like elements throughout, FIGS. 2–4 and 7 show a preferred embodiment of a control circuit in accordance with the present invention.

Figure 1B:
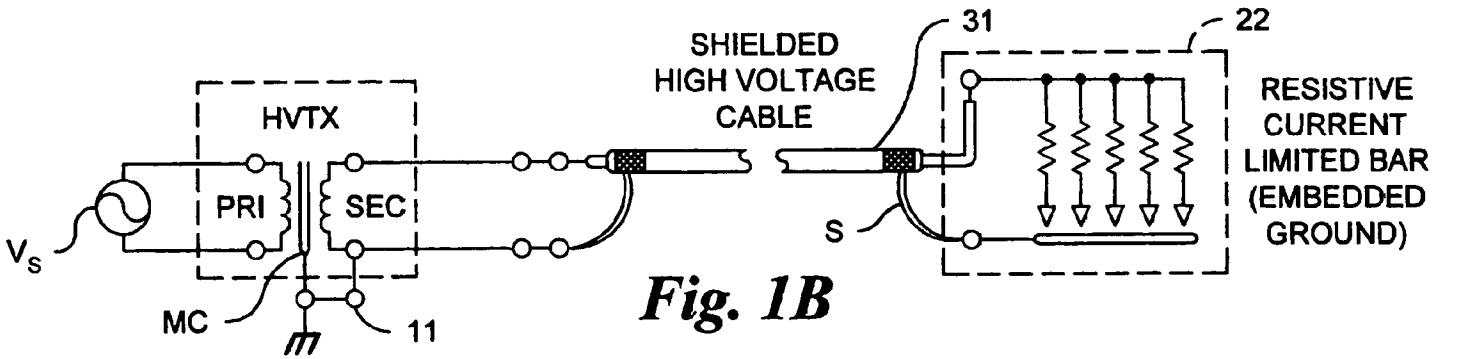
FIG. 1B is a simplified electrical schematic of a resistive current limited ionizer bar which can incorporate the preferred embodiments of the present invention.
Figure 1C:
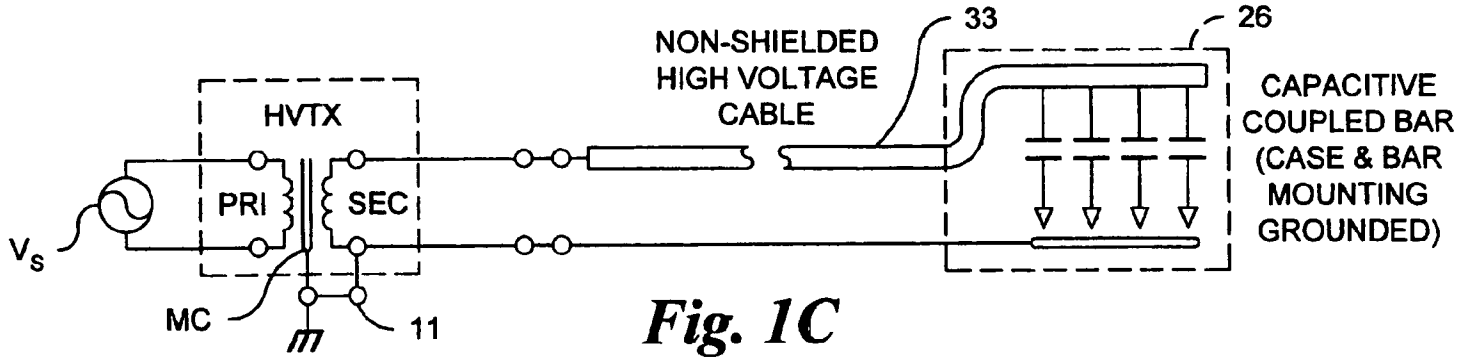
FIG. 1C is a simplified electrical schematic of for a capacitive coupled ionizer bar which can incorporate the preferred embodiments of the present invention.

In FIGS. 1A–1C, a voltage source $V_S$ is electrically coupled to a high voltage transformer HVTX having a primary winding or primary PRI, a secondary winding SEC and a magnetic core MC. Preferably, the voltage source $V_S$ is a standard alternation current (AC) voltage source, such as about 90–600 volts alternating current (VAC) at about 50–400 Hertz (Hz) and the like. Of course, any AC voltage source $V_S$ may be utilized without departing from the present invention. The high voltage transformer HVTX may be any Ferro or non-Ferro-type high voltage transformer HVTX with the magnetic core MC grounded to earth. One-leg or portion of the secondary winding or simply secondary SEC of the high voltage transformer HVTX is grounded to earth. However, the connection to earth ground may be interrupted creating a node 11 for connection or coupling to a sensing circuit 10 (FIG. 2) as will be described in greater detail below. The voltage source $V_S$ may include other types of AC power supplies without departing from the invention. Furthermore, the high voltage transformer HVTX may be other types of power supplies and/or power converters such as a switching power supply and the like.

In FIGS. 1A and 1B the ionizer bar 24, 22 is connected to the high voltage transformer HVTX via a shielded cable 31. The shielded cable 31, having a shield S coupled to ground, generally provides suppression of AC electric fields and aids in the reduction of electromagnetic interference (EMI) emissions, but depending on length, the shielded cable 31 can represent a capacitive load of up to ⅔ of the maximum output of the high voltage transformer HVTX. The load current to the shield S of the shielded cable 31 in this case is several orders of magnitude larger than a current to an emitter pin or electrode. The loading from the shielded cable 31 limits the amount, in terms of linear measurement, of the bar and shielded cable 31 that can be connected to the high voltage transformer HVTX. In FIG. 1C, there is an unshielded cable 33 coupled between the high voltage transformer HVTX and the ionizer bar 26, which allows for the longest linear length, but without a shield S very little or no EMI or AC electric field suppression is provided. If the cable 33 is mounted away from ground the only load on the power supply should be the resistance of the cable 33 and ion current. The typical short circuit current of an emitter pin to earth ground is between about 7.5–11 microamperes (μA) for a capacitive coupled bar and between about 30–50 μA for a resistive bar.

Figure 2:
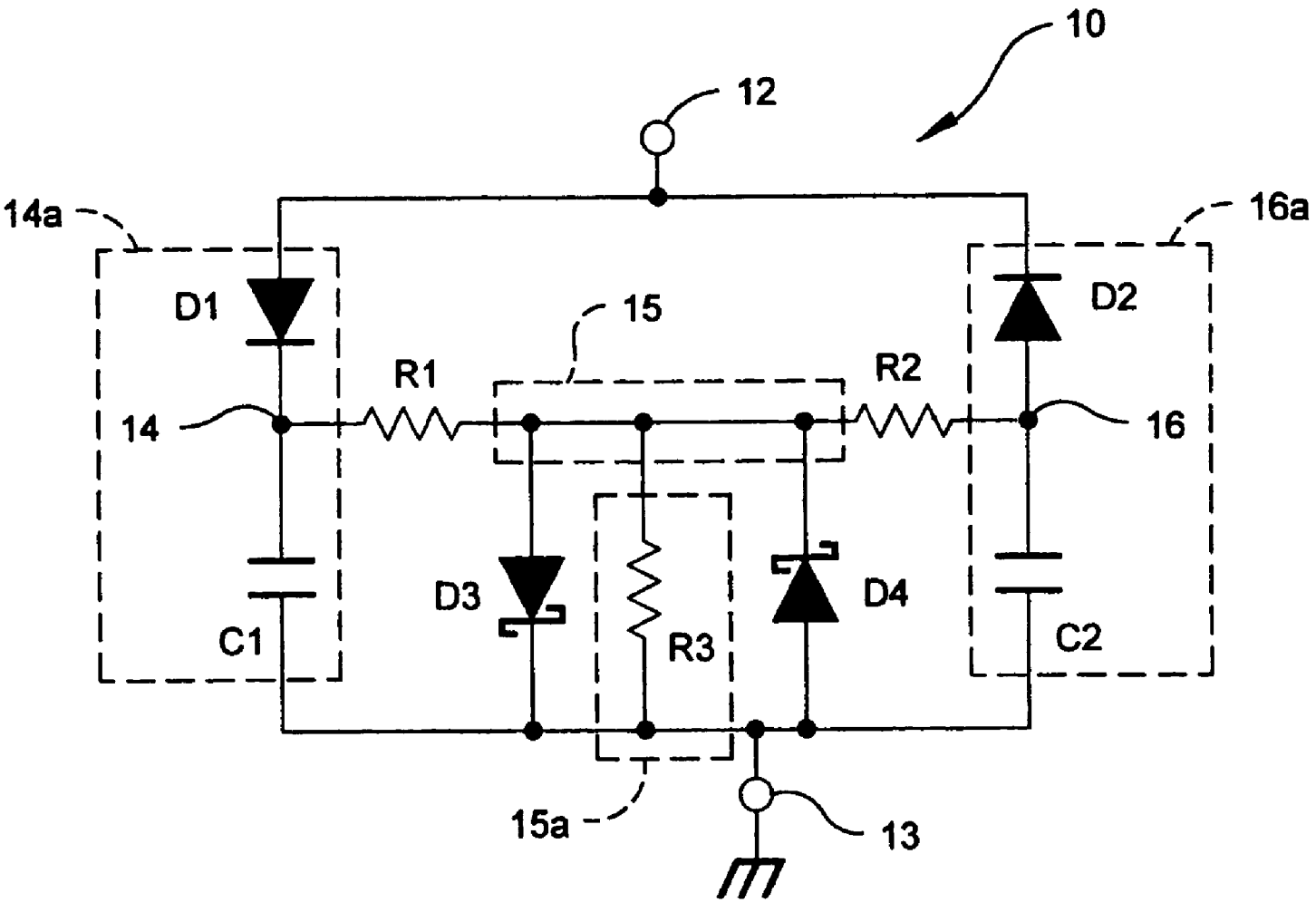
FIG. 2 is a simplified electrical schematic of a sensing circuit that measures alternating current in ionizer bars in accordance with a preferred embodiment of the present invention.

FIG. 2 is a simplified electrical schematic of a sensing circuit 10 that measures alternating current (AC) in the secondary SEC of high voltage transformers HVTXs for air ionizers 22, 24, 26 (FIGS. 1A–1C) and 222 (FIG. 7), in general, in accordance with a preferred embodiment of the present invention. The sensing circuit 10 includes a positive ion current sense node 14, a negative ion current sense node 16, a ground node 13, a return current nulling node 12 and a balance sensing node 15. The sensing circuit 10 also includes various electrical components including capacitors C1–C2, diodes D1–D4, and resistors R1–R3. The sensing circuit 10 includes a positive ion current sensor 14*a*, comprising a diode D1 and a capacitor C1, is coupled between the return current nulling node 12 and the ground node 13. Diode D1 allows capacitor C1 to charge only during a positive half-cycle of an AC waveform to store the value of the positive ion current produced with respect to earth ground. The value of capacitor C1 is selected to provide a desired response time, and to reduce the AC ripple of the measurement (i.e., a smaller capacitor equals a faster response time and a larger amount of unwanted AC ripple in the measurement). Similarly, a negative ion current sensor 16*a*, comprising a diode D2 and a capacitor C2, is coupled between the return current nulling node 12 and the ground node 13. Diode D2 allows capacitor C2 to charge only during the negative half-cycle of an AC waveform to store the value of a negative ion current produced with respect to earth ground. The value of capacitor C2 is likewise selected to provide a desired response time, and to reduce AC ripple of the measurement (i.e., a smaller capacitor equals a faster response time and a larger amount of unwanted AC ripple in the measurement). Thus, the positive ion current sense node 14 is configured to output a positive ion signal proportionate to a positive ion current, and the negative ion current sense node 16 is configured to output a negative ion signal proportionate to a negative ion current.

The ground node 13 couples the sensing circuit 10 to earth ground to provide a return path for the positive and negative ion current produced in each full cycle of an AC waveform. The return current nulling node 12 couples the sensing circuit 10 to the secondary winding SEC of the high voltage transformer HVTX and to the shield S of the shielded cable 31. The shield S of the shielded cable 31 must be connected at this return current nulling node 12 in order to return the large current from the shield S back to the high voltage transformer HVTX allowing the sensing circuit 10 to receive only ion current. If the shield S is earth grounded, the ion current, which at the maximum would be less than a few hundred microamperes (μA), is effectively negligible compared to the 1–3 milliampere (mA) current signal of the shield S, and therefore, is difficult to detect or measure.

The balance sensing node 15 is a summing node that offers a balanced discharge path for the both capacitors C1 and C2. Capacitor C1 discharges through resistors R1 and R3, and capacitor C2 discharges through resistors R1 and R3. If no charge is present on the target, the net current will be equal and the voltage at the balance sensing node 15 will be about zero (0) volts. If, however, a charge is present on the target, the measurable voltage at the balance sensing node 15 will increase in voltage proportionally to the discharge current and sign of the charge (i.e., if the target has a positive charge, the measurable voltage at the balance sensing node 15 will be also be a positive voltage; and if the target charge is negative, the measurable voltage at the balance sensing node 15 will be negative because the ionizer is grounded and both signals shift together). The balance sensing node 15 can be connected to an amplifier (not shown) to illuminate a light emitting diode (LED) (not shown) or to drive an analog or digital indicator (not shown) in order to display a relative "charge" of the target. Thus, the balance sensing node 15 is configured to output an ion balance signal proportionate to a balanced ion current.

Resistors R1 and R2 set the "signal level" for the positive and negative ion current measurement by serving as voltage-drop devices. Similarly, resistor R3 sets the signal level for the balance measurement (between positive and negative) at the balance sensing node 15. Diodes D3 and D4 provide a clamp for this signal in the event that a very large charge is present on the target to be discharged. Preferably, the diodes D3, D4 are Schottky diodes which restrict or "clip" the voltage because the voltage at the balance sensing node 15 might otherwise be relatively large. However, any other known clipping/restricting device such as transorb, Zener diode and the like may be utilized without departing from the invention.

Figure 3:
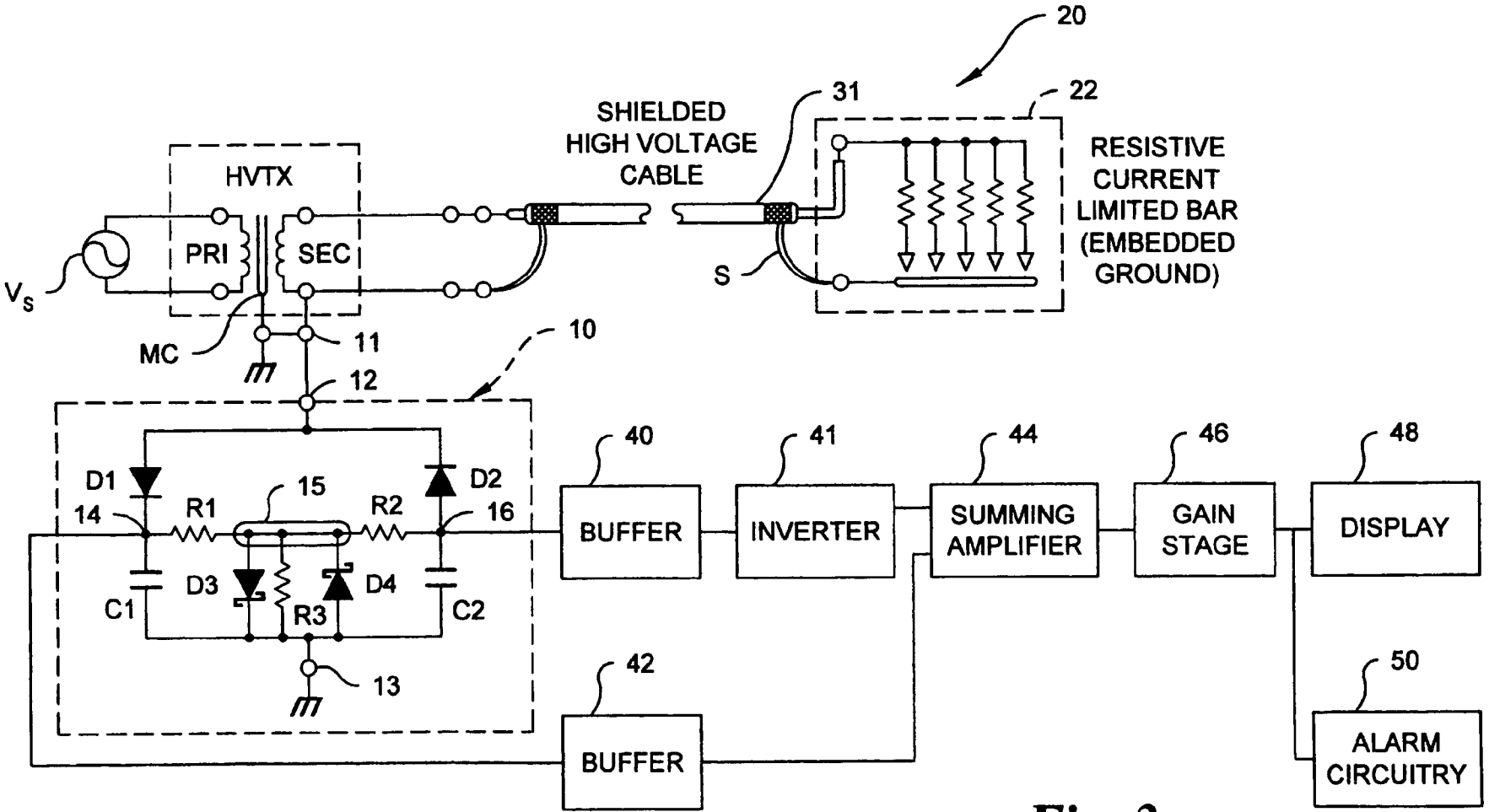
FIG. 3 is a simplified electrical schematic of a monitor circuit for a resistive current limited ionizer bar which incorporates the sensing circuit of FIG. 2 along with optional features.

FIG. 3 is a simplified electrical schematic of a monitoring circuit 20 for a resistive current limited ionizer bar 22 which incorporates the sensing circuit 10 of FIG. 2 along with other optional features including a negative signal buffer 40, an inverter 41, a positive signal buffer 42, a summing amplifier 44, a gain stage 46, a display 48 and alarm circuitry 50. The return current nulling node 12 is coupled to the secondary SEC of the high voltage transformer HVTX and to the shield S of the shielded cable 31. The ground node 13 is coupled to earth ground. The positive ion current sense node 14 is coupled to the positive signal buffer 42. The negative ion current sense node 16 is coupled to the negative signal buffer 40, and since the polarity of the negative ion current is negative, an output of the negative signal buffer 40 is coupled to the inverter 41. The outputs of the positive signal buffer 42 and the inverter 41 are summed by the summing amplifier 44 to create a composite signal of summed ion current. The summed ion current signal is then applied to the gain stage 46 in order to drive the display 48 and to provide an input to the alarm circuitry 50 at suitable useful voltage/current levels as is known in the art.

Alternatively, the summing amplifier 44 could be implemented as a difference amplifier and if the inverter 41 is eliminated, the difference of the positive and negative signals would yield a similar proportional signal. It is contemplated that inverter 41 could be left in place along with the difference amplifier to yield an ion balance (difference between the positive and negative ion signals) similar to the signal at node 15, but perhaps different in level.

Figure 4A:
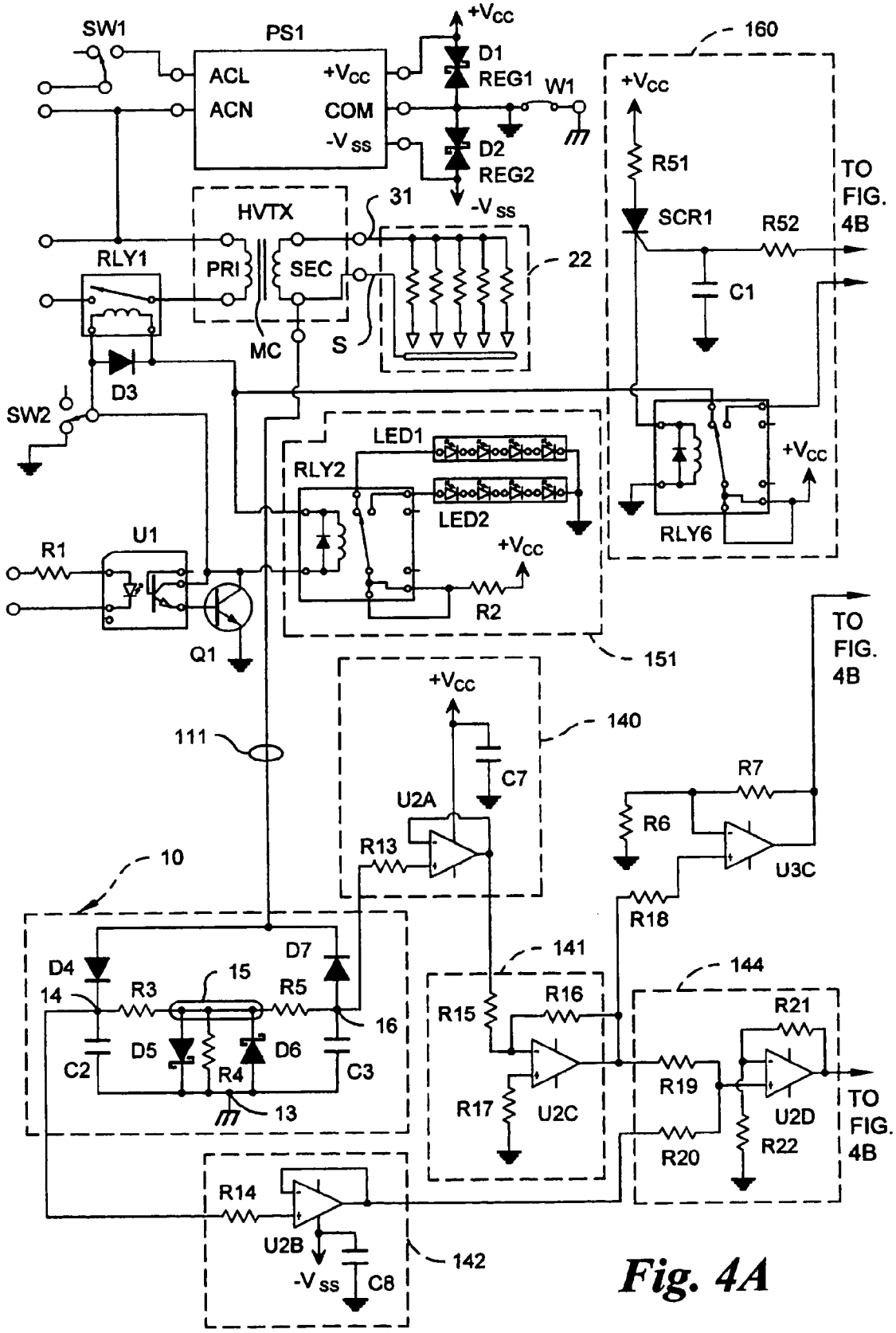
FIGS. 4A–4B are a detailed electrical schematic of a preferred embodiment of the control circuit of FIG. 3.
Figure 4B:
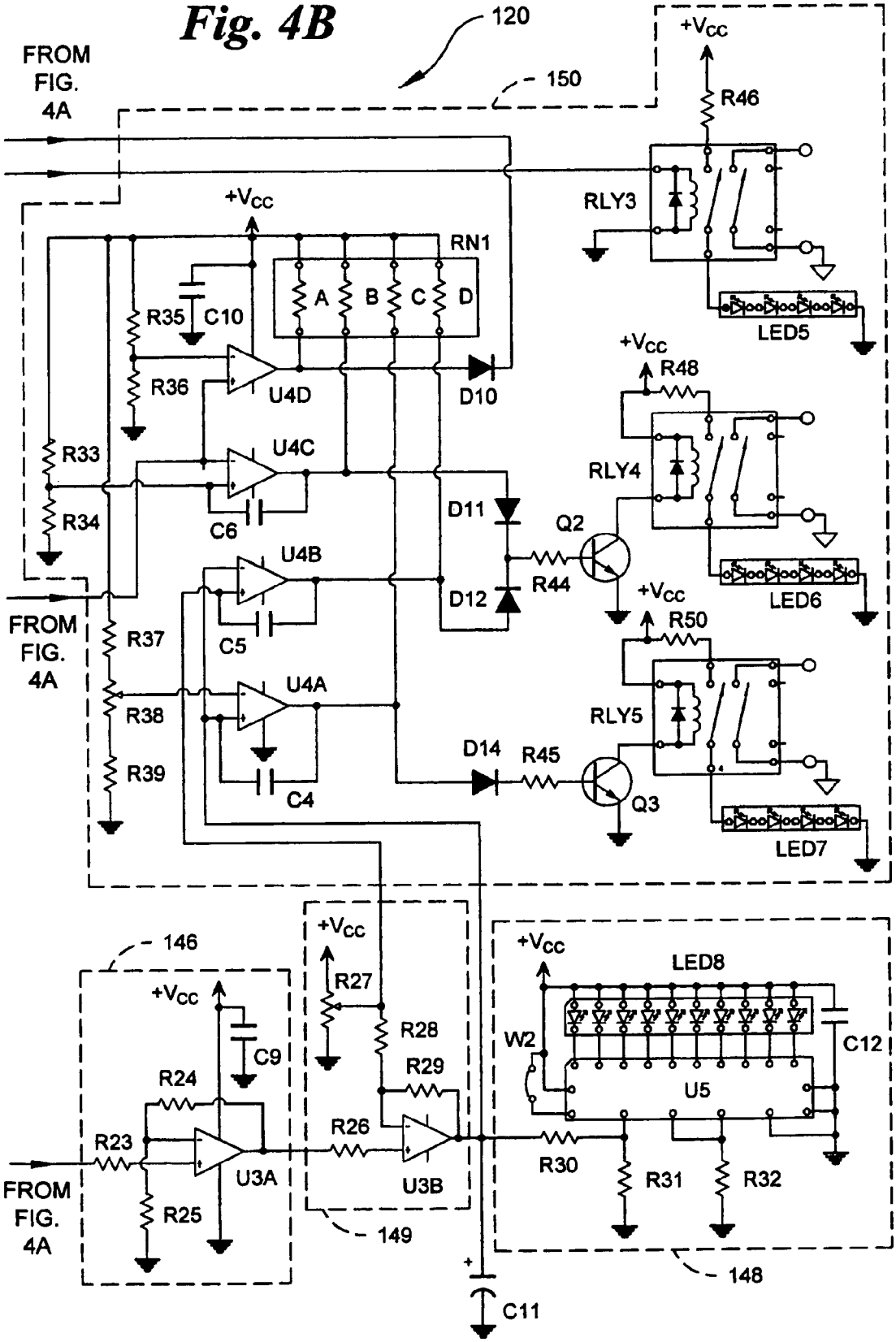
Figure 5:
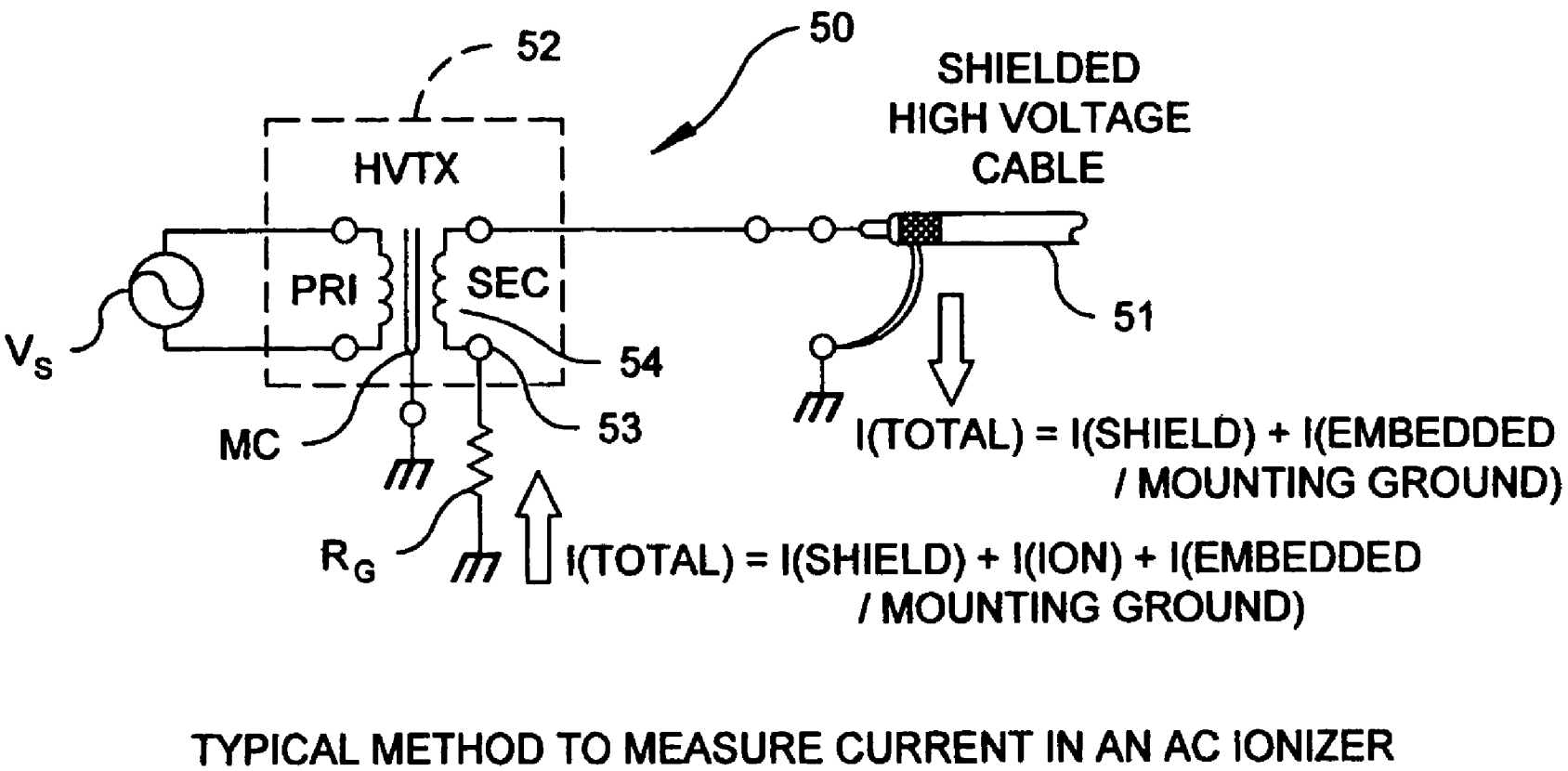
Fig. 5 (Prior Art)
FIG. 5 is a simplified electrical schematic of a prior art circuit that measures return current through a grounded resistor.

FIGS. 4A–4B illustrate a detailed electrical schematic of a control circuit 120 similar to the diagrammatic monitoring circuit 20 depicted in FIG. 3 in accordance with the present invention. The detailed control circuit 120 is shown with a resistive current limited ionizer bar 22, but could be coupled to any transformer-based ionizer 222 or ionizer bar 22, 24, 26. The control circuit 120 also incorporates the sensing circuit 10 of FIG. 2 along with other optional features including a negative signal buffer 140, an inverter 141, a positive signal buffer 142, a summing amplifier 144, a gain stage 146, a display 148, alarm circuitry 150 and an interlock 160. The return current nulling node 12 is coupled to the secondary SEC of the high voltage transformer HVTX and to the shield S of the shielded cable 31. The ground node 13 is coupled to earth ground.

AC voltage supplied to the control circuit 120 at input terminals E1 and E2 at between about 90 Volts AC and 250 Volts AC at about 50 to 60 Hz. A direct current (DC) power supply PS1 converts AC voltage to DC voltage for use by the integrated and discrete electrical/electronic components of the control circuit 120. The converted DC voltage may be between about 5 Volts DC and about 24 Volts DC. The power adapter PS1 is connected to a power switch SW1, which may be any two condition switch as is known in the art, but is preferably a two position toggle actuated switch with a dry-contact closure. The DC power supply PS1 delivers power to a first voltage regulator REG1 which regulates the voltage to about +12 VDC and a second voltage regulator REG2 which regulates the voltage to about −12 VDC. The regulated +12 VDC is depicted on the drawings as an upwardly directed arrow with a "$+V_{CC}$" designator. The regulated −12 VDC is depicted on the drawings as an downwardly directed arrow with a "$-V_{SS}$" designator. The first and second voltage regulators REG1, REG2 may be integrated circuit devices, diode bridges and the like, but preferably they are simply unidirectional Shutz diodes D1, D2 as depicted in FIGS. 4A–4B.

AC voltage supplied to the high voltage transformer HVTX at input terminals E3 and E4 at between about 90 Volts AC and 250 Volts AC at about 50 to 60 Hz. An interrupting relay RLY1 controls the power between input terminal E4 and the high voltage transformer HVTX. The control circuit 120 further includes a control mode selector switch SW2 which has a local position and a remote position. The mode selector switch SW2 may be a simple two position, dry contact type switch with a slide-type actuator, a rotary type actuator, push-to-set/push-to-reset actuator, or a toggle type actuator. Alternatively, the mode selector switch SW2 may simply pilot a relay, silicon controlled rectifier (SCR), transistor or the like to divert a plurality of outputs. Low voltage power ($+V_{CC}$) is supplied from a normally closed contact of an interlock relay RLY6 (described in greater detail below) through the coil of the interrupting relay RLY1. When the mode selector switch SW2 is in the local position, a transistor Q1 provides a path to ground. When the mode selector switch SW2 is in the remote position, a remote signal applied to terminals TB1-5, TB1-6, selectively controls the state of transistor Q1 to thereby remotely control the interrupting relay RLY1. Preferably, the remote signal is optically isolated through an opto-isolator or optically coupled solid-state relay U1.

A BAR-ON/BAR-OFF indicator 151 circuit primarily includes a BAR-ON/BAR-OFF relay RLY2 having a coil coupled to the signal which drives the interrupting relay RLY1, a common coupled to +VCC, a normally open contact coupled to a BAR-ON (green) indicator light LED1 and a normally closed contact coupled to a BAR-OFF (red) indicator light LED2. The BAR-ON/BAR-OFF relay RLY2 indicates when AC power is being applied to the high voltage transformer HVTX primary by illuminating the BAR-ON LED2 and indicates when AC power has been removed from the high voltage transformer by illuminating the BAR OFF LED1. The BAR-ON/BAR-OFF relay RLY2 may also have other normally open or normally closed contacts (not shown) for providing external signals or annunciation.

The positive ion current sense node 14 is coupled to the positive signal buffer 142. The positive signal buffer 142 includes a drop resistor R14 and an operational amplifier (op-amp) U2B configured as a buffer. The negative ion current sense node 16 is coupled to the negative signal buffer 140, and since the polarity of the negative ion current is negative, an output of the negative signal buffer 140 is coupled to the inverter 141. The negative signal buffer 140 includes a drop resistor R13 and an op-amp U2A configured as a buffer. The inverter 141 includes an op-amp U2C along with suitable biasing and feedback resistors R15–R17 configured to invert the polarity of the input signal to the inverter 141.

The outputs of the positive signal buffer 142 and the inverter 141 are summed by the summing amplifier 144 to create a composite signal of summed ion current. The summing amplifier 144 includes input resistors R19 and R20 for the negative and positive signals (in absolute value) and an op-amp U2D having suitable biasing and feedback resistors R21, R22 and being configured as a summing amplifier. The summed ion current signal is then applied to the gain stage 146 in order to drive the display 148 and to provide an input to the alarm circuitry 150 at suitable useful voltage/current levels. The gain stage 146 includes input resistor R23 for the summed ion signal and an op-amp U3A having suitable biasing and feedback resistors R24, R25 and being configured as a gain amplifier. The output of the gain stage 146 may be applied directly to the display 148 and the alarm circuitry 150, however, as shown here, an optional adjustable amplifier stage 149 is provided. The adjustable amplifier stage 149 includes input resistor R26 for the amplified ion signal and an op-amp U3B having suitable biasing and feedback resistors R29 and R28 and the adjustable amplifier stage 149 configured as a gain amplifier. A bar set-up potentiometer R27 is tied to the feedback of the op-amp U3B to make the relative output level adjustable. In an alternate embodiment, the potentiometer R27 may be replaced with a laser trimmed resistor, a selectable resistor bank or the like.

The display 148 in the present embodiment includes a bar graph display LED8 which is driven by a bar-graph driver integrated circuit (IC) US along with suitable biasing components including resistors R30–R32 and capacitor C12. The bar graph display LED8 roughly indicates the amount of ion current being output from the measured air ionizer 22, 24, 26, 222. Of course other indicators, either analog or digital, which display relative or precise ion current may be utilized without departing from the present invention.

The alarm circuitry 150 includes a number of trip functions including a fault indicator LED5, a service indicator LED6 and a clean bar indicator LED7. The interlock 160 works in conjunction with the alarm circuitry 150 to interrupt power to the high voltage transformer HVTX when there is a large voltage on the sensing circuit 10. The interlock 160 includes an interlock silicon controlled rectifier SCR1, the interlock relay RLY6 as well as suitable biasing components including resistors R51–R52 and capacitor C1.

The inverted negative ion current signal from the inverter 140 as amplified through op-amp U3C is coupled to various locations within the alarm circuitry 150 including as reference inputs to op-amps U4C and U4D. The output of op-amp U4D is applied to the gate of the interlock silicon controlled rectifier SCRI which in turn drives the interlock relay RLY6. In the event a large voltage develops on the sensing circuit 10, which could be measured by either polarity ion current signal, the interlock SCRI is gated thereby energizing the interlock relay RLY6. The normally closed contact of the interlock relay RLY6 then drives a fault indictor relay RLY3 which causes the fault indicator LED5 to illuminate. The fault indicator relay RLY3 may also have other normally open or normally closed contacts for providing external signals or annunciation.

The amplified inverted negative ion current signal from op-amp U3C is coupled to an input of comparator U4C (i.e., an op-amp configured to compare inputs) for determining if there is a no signal condition. Similarly, the output of the op-amp U3B and the biased feedback of op-amp U3B are applied to the inputs of comparator U4B for determining if there is a no signal condition for the summed and amplified ion signal as well. If either condition is true, transistor Q2 is energized in order to drive a service relay RLY4 which in turn illuminates the service indicator LED6. The service relay RLY4 may also have other normally open or normally closed contacts for providing external signals or annunciation.

The output of the op-amp U3B is also applied to the non-inverting input of comparator U4A for comparison to a user selectable value derived from potentiometer R38 in order to determine if the amplified summed ion current signal has increased beyond a certain desired setpoint. The output of the comparator U4A energizes a clean-bar transistor Q3 in order to drive a clean-bar relay RLY5 which in turn illuminates the clean bar indicator LED7.

Thus, the control circuit 120 provides for the following alarm and/or display indications:

i) BAR ON—high voltage present on the ionizer 22, 24, 26, 222;

ii) BAR OFF—no high voltage on the ionizer 22, 24, 26, 222;

iii) CLEAN BAR—indicating when it is time to clean a dirty ionizer 22, 24, 26, 222;

iv) FAULT—indicates that the interlock 161 has deenergized the high voltage transformer HVTX when the high voltage is shorted to earth ground; and v) SERVICE—indicates that emitter pins of ionizer 22, 24, 26, 222 are covered by an insulator.

Figure 7:
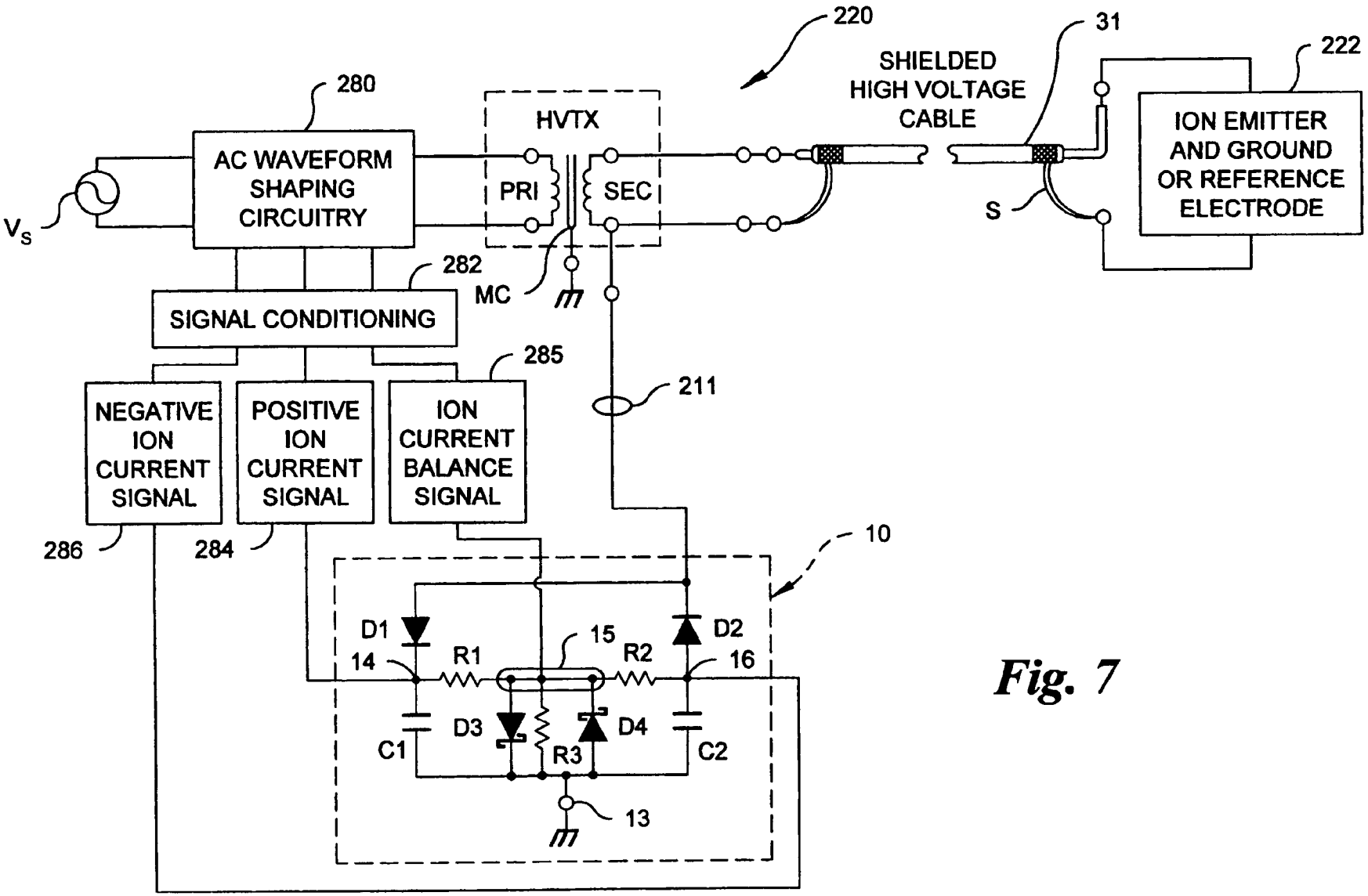
FIG. 7 is a simplified electrical schematic of a control circuit for an ion emitter and ground reference which can incorporate the preferred embodiments of the present invention.

FIG. 7 is a simplified electrical schematic of a control circuit 220 for an ion emitter and ground reference or simply an AC ionizer 222 which can incorporate the preferred embodiments of the present invention. The control circuit 220 can control ion production and balance the output (in terms of ion production) of an AC ionizer 222 in a closed loop feedback scheme using the invented sensing circuitry. The control circuit 220 can make automatic corrections to both output of levels of either polarity and balance of the AC ionizer 222. The sensing circuit 10, as described in detail above with respect to FIG. 2, is coupled to signal conditioning circuitry 282 in order to amplify or restrict the voltages derived at the nodes to suitable levels. In particular, the signal conditioning circuitry 282 is used to scale the positive and negative ion current signals and the ion current balance signal to levels compatible with the reference of the control circuit 220 and comparable, in terms of level, to one another. By comparison of the positive and negative ion current signals or the balancing signal and to reference levels, which may be set by a user or by a computer system for example, corrections to the AC waveform being applied to the high voltage transformer HVTX can be implemented in order to appropriately correct ion production. Waveform shaping circuitry 280, which may be comprised of SCRs, Triacs or IGBTs along with drive circuitry to clamp or clip the waveform supplied by the AC line, is coupled to the positive and negative ion current signals 284, 286 and the ion current balance signal 285 through the signal conditioning circuitry 282. When the AC waveform has been adjusted to compensate for the changes requested by the sensing circuit this signal is supplied to the high voltage transformer HVTX causing the appropriate change in ion output and causing the system to track the desire set-points. The three signals from the sensing circuit could be used so that the positive and negative ion currents signals could control the shape of their respected outputs and the balance signal could serve as an error signal to confirm that the correct changes were made. The role of each of three signals can be inter-changed with each other to maintain or report the condition of the outputs ion production.

Figure 6:
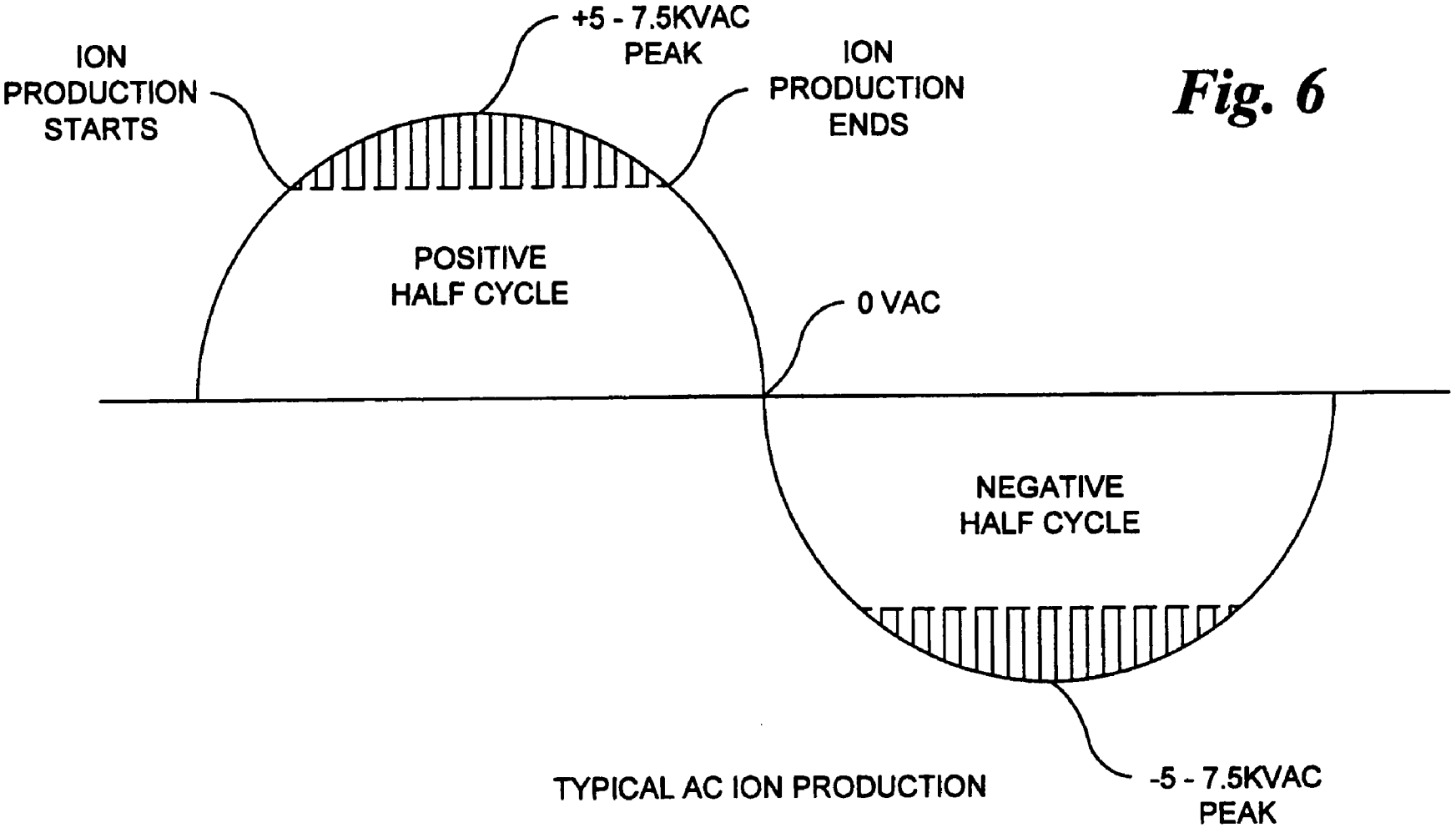
FIG. 6 is a graph depicting alternating current ion generation during a full cycle.

FIG. 6 is a graph depicting alternating current ion generation during a full cycle. FIG. 6 illustrates the timing of ion production for a typical cycle of an AC ionizer 222. An emitter of a typical air ionizer 222 breaks into corona and starts to produce ions at approximately 3 kilovolts AC (KVAC); the ionizer 222 continues production of positive ions for the portion of the AC waveform above this threshold. The same is true for the negative half-cycle of the AC high voltage waveform. Typical high voltage outputs for an air ionizer 222 are about 5 to 7.5 KVAC peak, which means that the emitter of the ionizer 222 is producing ions for only a fraction of the overall half-cycle of the AC waveform.

Figure 8:
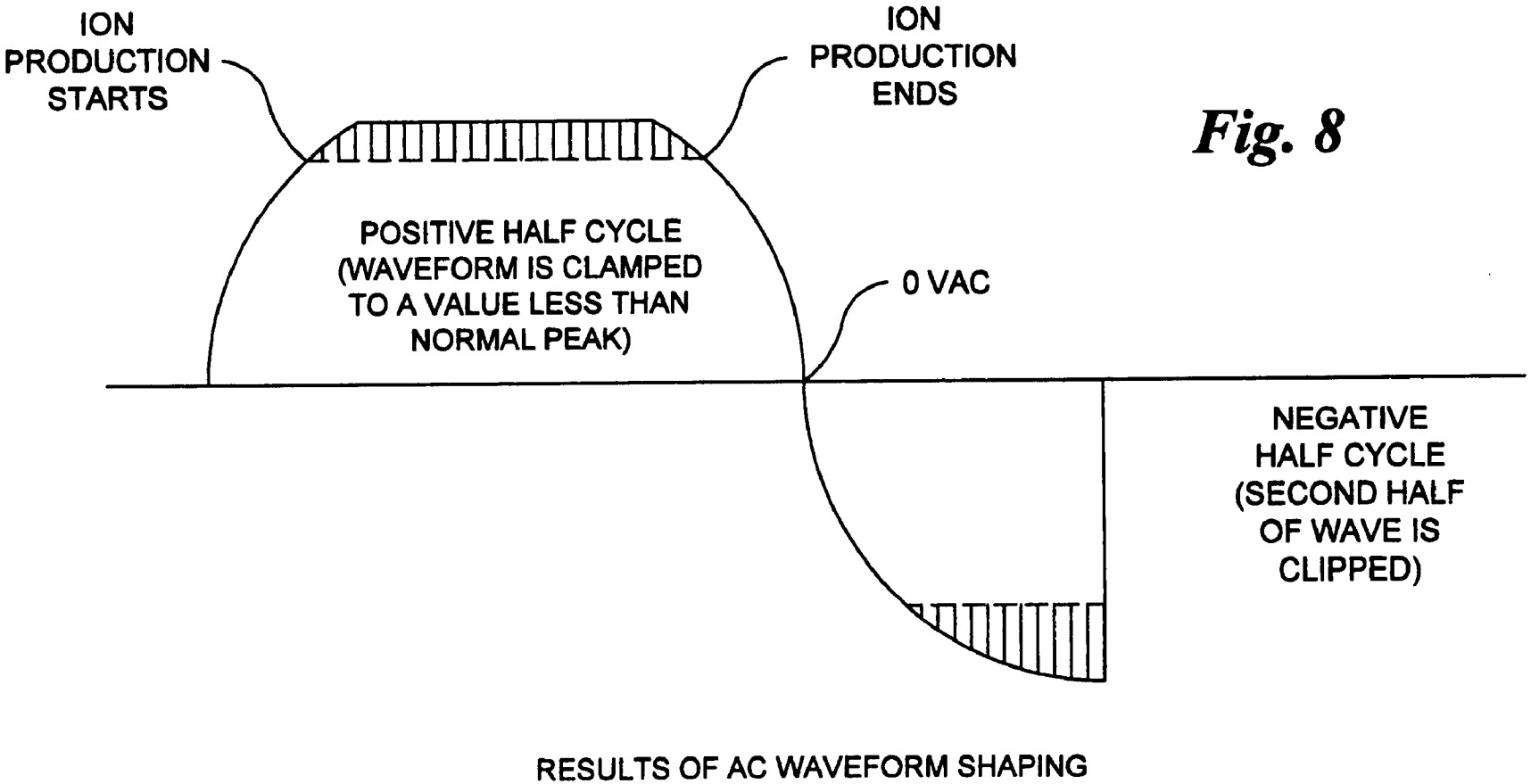
FIG. 8 is a graph depicting waveform shaping for alternating current ion generation during a positive and negative half-cycle.

FIG. 8 is a graph depicting waveform shaping for alternating current ion generation during a positive and negative half-cycle. FIG. 8 illustrates three ways the waveform shaping circuit could change the ion production on the output. The positive half-cycle represents a method to restrict or clamp the AC input voltage being applied to the high voltage transformer HVTX to a reduced voltage level. Clamping of the AC input voltage results in correspondingly reduced high voltage output level during the period of ion production, and a subsequent reduction of ion production of that polarity. The negative half-cycle represents a method to clip the AC input voltage being applied to the high voltage transformer HVTX to a reduced duty cycle. Reducing the duty cycle of the AC input voltage limits the amount of time ions are being produced. Alternatively, both forms of or any variation of clipping and/or clamping of AC input voltage being applied to the high voltage transformer HVTX to thereby control ion production.

From the foregoing, it can be seen that the present invention comprises a sensing circuit and/or a control circuit for AC ionizers having a nulling node. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An ionizer comprises:

an alternating current (AC) voltage source having an output outputting a waveform with a positive half-cycle ant a negative half-cycle;

an electrode electrically coupled to the output of the AC voltage source;

a reference proximate the electrode; and a sensing circuit including:

a return current nulling node electrically coupled to the output of the AC voltage source and the reference;

a ground node separately electrically coupled to ground;

a positive ion current sensor having a positive ion current sense node and being coupled between the return current nulling node and the ground node, the positive ion current sense node being configured to output a positive ion signal proportionate to a sensed positive ion current;

a negative ion current sensor having a negative ion current sense node and being coupled between the return current nulling node and the ground node, the negative ion current sense node being configured to output a negative ion signal proportionate to a sensed negative ion current; and a feedback control circuit coupled to at least one of the positive ion current sense node and the negative ion current sense node, the feedback control circuit being coupled between the AC voltage source and the electrode, the feedbaek control circuit being configured to control the AC waveform being applied to the electrode based upon at least one of the positive ion signal and the negative ion signal.

2. The ionizer according to claim 1, wherein the sensing circuit further comprises a balance sensing node coupled between the positive ion current sensor and the negative ion current sensor and a balance sensing sensor coupled between the balance sensing node and the ground node, the balance sensing node being configured to output an ion balance signal proportionate to a balanced ion current.

3. The ionizer according to claim 2, wherein the balance sensing sensor includes a resistor.

4. The ionizer according to claim 2, wherein the balance sensing sensor includes a voltage limiting device.

5. An ionizer comprises:

an alternating current (AC) voltage source having an output outputting a waveform with a positive half-cycle and a negative half-cycle;

an electrode electrically coupled to the output of the AC voltage source;

a reference proximate the electrode; and a sensing circuit including:

a return current nulling node electrically coupled to the output of the AC voltage source and the reference;

a ground node separately electrically coupled to ground;

a positive ion current sensor having a positive ion current sense node and being coupled between the return current nulling node and the ground node, the positive ion current sense node being configured to output a positive ion signal proportionate to a sensed positive ion current; a negative ion current sensor having a negative ion current sense node and being coupled between the return current nulling node and the ground node, the negative ion current sense node being configured to output a negative ion signal proportionate to a sensed negative ion current; and a balance sensing node coupled between the positive ion current sensor and the negative ion current sensor and a balance sensing sensor coupled between the balance sensing node and the ground node, the balance sensing node being configured to output an ion balance signal proportionate to a balanced ion current;

a feedback control circuit coupled to the balance sensing node, the feedback control circuit being coupled between the AC voltage source and the electrode, the feedback control circuit being configured to control the AC waveform being applied to the electrode based upon at least the ion balance signal.

6. The ionizer according to claim 1, wherein the positive ion current sensor includes a diode and a capacitor, the diode being coupled to the return current nulling node so as to detect only positive half-cycles of AC.

7. The ionizer according to claim 6, wherein the diode permits the capacitor to charge only on the positive half-cycle thereby storing a value relative to a positive ion current produced during the positive half-cycle.

8. The ionizer according to claim 1, wherein the negative ion current sensor includes a diode and a capacitor, the diode being coupled to the return current nulling node so as to detect only negative half-cycles of AC.

9. The ionizer according to claim 8, wherein the diode permits the capacitor to charge only on the negative half-cycle thereby storing a value relative to a negative ion current produced during the negative half-cycle.

10. The ionizer according to claim 1, wherein the AC voltage source further comprises a transformer having a primary winding and a secondary winding, the secondary producing the output of the AC voltage source.

11. The ionizer according to claim 10, further comprising a shielded cable having a conductor and a shield, the conductor connecting the secondary of the transformer to the electrode and the shield connecting the reference to the return current nulling node and the secondary of the transformer.

12. The ionizer according to claim 1, further comprising:

an inverter coupled to one of the positive ion current node and the negative ion current node, the inverter being configured to invert voltage polarity, and a summing amplifier coupled to the inverter and the other of the positive ion current sense node and the negative ion current sense node, the summing amplifier generating a composite signal of summed ion current.

13. The ionizer according to claim 1, further comprising:

an inverter coupled to one of the positive ion current node and the negative ion current node, the inverter being configured to invert voltage polarity, and a difference amplifier coupled one of the positive ion current node and the negative ion current node and the other of the positive ion current sense node and the negative ion current sense node, the difference amplifier generating an overall ion output signal.

14. The ionizer according to claim 1, further comprising:

an inverter coupled to one of the positive ion current node and the negative ion current node, the inverter being configured to invert voltage polarity, and a difference amplifier coupled to the inverter and the other of the positive ion current sense node and the negative ion current sense node, the difference amplifier generating a composite signal of summed ion current.

15. The ionizer according to claim 1, further comprising:

a display coupled to the summing amplifier and configured to display an ionizer ion output indication based on the sum of the positive and negative ion current.

16. The ionizer according to claim 1, further comprising a shielded cable having a conductor and a shield, the conductor connecting the output to the electrode and the shield connecting the reference to the return current nulling node.

17. The ionizer according to claim 1, further comprising at least one of a clean electrode indicator, a service indicator, a fault indicator, an on indicator and an off indicator.

18. An ionizer comprises:

an alternating current (AC) voltage source having an output outputting a waveform with a positive half-cycle and a negative half-cycle;

an electrode electrically coupled to the output of the AC voltage source;

a reference proximate the electrode;

a shielded cable having a conductor and a shield, the conductor connecting the output to the electrode; and a sensing circuit including:

a return current nulling node electrically coupled to the output of the AC voltage source and the reference, the shield of the shielded cable connecting the reference to the return current nulling node;

a ground node separately electrically coupled to ground; and an ion current sensor having an ion current sense node and being coupled between the return current nulling node and the ground node, the ion current sense node being configured to output an ion signal proportionate to a sensed ion current.

* * * * *